US005369806A

United States Patent [19]

Chan

[11] Patent Number: 5,369,806

[45] Date of Patent: Dec. 6, 1994

[54] WELDING GLOVE HAVING FLOAT RESISTANT FOAM INNER LAYER

[76] Inventor: Yat M. Chan, 113 E. Centre St., Nutley, N.J. 07110

[21] Appl. No.: 49,187

[22] Filed: Apr. 21, 1993

[51] Int. Cl.[5] ..... A41D 13/10

[52] U.S. Cl. ..... 2/161.6; 2/164; 2/272

[58] Field of Search ..... 2/161.6, 167, 159, 164, 2/272, 267

[56] References Cited

U.S. PATENT DOCUMENTS

| | | | |
|---|---|---|---|
| 2,004,382 | 6/1935 | Palicki | 2/164 |
| 2,304,137 | 12/1942 | Peakes | 2/164 X |
| 2,610,326 | 9/1952 | Sabin | 2/161.6 |
| 2,650,365 | 9/1953 | Singer | 2/161.6 X |
| 2,703,887 | 3/1955 | Kennedy | 2/167 |
| 4,445,232 | 5/1984 | Nelson | 2/167 X |
| 4,495,661 | 1/1985 | Kamat | 2/272 X |
| 4,663,783 | 5/1987 | Obayashi | 2/164 X |
| 4,723,324 | 2/1988 | Lassiter | 2/161.6 X |
| 4,727,602 | 3/1988 | Giese et al. | 2/161.6 X |
| 5,138,718 | 8/1992 | Willard | 2/164 X |
| 5,236,769 | 8/1993 | Paire | 2/272 X |

*Primary Examiner*—Clifford D. Crowder
*Assistant Examiner*—John J. Calvert
*Attorney, Agent, or Firm*—M. K. Silverman

[57] ABSTRACT

A glove for the protection of the hand of a welder from heat and burning during welding operations, includes a leather outer shell having a thickness in the range of about 0.8 to about 1.9 millimeters. The glove, within the outer shell, further includes an open-cell compressible flame retardant intermediate foam-like layer having a thickness in the range of about 2.3 to about 4.5 millimeters, a density in the range of about 1.5 to about 25 kilograms per cubic meter, and a porosity and compressibility in the range of about 25 to about 75 percent. The innermost layer of the glove, opposing the hand of the user, constitutes a felt-like cotton layer having a multiplicity of convection passages, said layer having a thread strand density characteristic in the range of about 5 to about 30 strands per lineal inch, a thickness in the range of about 1 to about 3 millimeters, and a density in the range of about 100 to about 200 kilograms per cubic meter. A glove of enhanced insulative capacity, comfort and gripping functionality is obtained.

12 Claims, 1 Drawing Sheet

WELDING GLOVE HAVING FLOAT RESISTANT FOAM INNER LAYER

BACKGROUND OF THE INVENTION

The present invention relates to the area of fire resistant and flame retarding gloves of the type used in welding applications. The prior art of welding gloves as, more particularly, is set forth below, teaches gloves having, as the focus thereof, either an advantage of comfort or safety, but not both in a single glove.

References such as U.S. Pat. No. 4,445,232 (1984) to Nelson, entitled Welder's Glove teach the use of a closed-cell foam having improved properties of heat resistance and flame retarding.

U.S. Pat. No. 2,650,365 (1953) to Singer, entitled Flame- and Heat-Resistant Work Glove teaches the use of an intermediate layer of a fiber or filament-like material impregnated with a flame-retardant composition. The approach of Singer provides limited cushioning effect and, as well, is not designed or intended to provide breath-ability to the hand of the user.

The use of temperature resistant fibers employing contemporary materials such as KEVLAR is taught in U.S. Pat. No. 4,433,439 (1984) to Sidman, entitled Heat Resistant Protective Hand Covering.

The use of a felt-like fabric, which comprises a form of compressed cotton material as an inner liner to a glove employing a middle fiber layer of Kevlar, is taught in U.S. Pat. No. 4,454,611 (1984) to Tschirch, entitled Heat Resistant Protective Hand Covering.

The use of absorbable apertures or perforations within the innermost layer of a glove structure for the purpose of enhancing breathability of the hand of the user is taught in U.S. Pat. No. 4,727,602 (1988) to Giese, entitled Insulated Handwear Construction.

While the art of record, as above set forth, discloses a number of laminated glove structures, only said references to Singer and Nelson make any reference to the utility of such structures in a welding environment. Further, while the prior art discloses the treatment of a fiber like layer with a flame retardant composition, the art of record does not show the usage of a polymeric foam layer which is impregnated or otherwise treated with a flame-retardant material. Also, the prior art, to the extent which it has utilized foam or layers thereof (for example, see U.S. Pat. No. 4,430,759 (1984) to Jackrel, entitled Glove) does not make use of any open-celled foam layer, whether or not impregnated or otherwise treated with a heat- or flame-resistant composition.

Further, while the prior art teaches the use of felt-cotton as an innermost hand-opposing layer, it does not teach any method of adhering the felt layer to an intermediate foam layer in a fashion that will not compromise the flexibility or breathability of the felt layer or the capacity of the felt and foam layers to operate together as an effective system. It is, therefore, to be appreciated that the prior art does not teach a glove suitable for use by a welder which combines therein the benefits of comfort and breathability associated with felt cotton with an open-celled foam-like material and the advantages of safety and gripability which are afforded by the compressible air barrier created by the use of such an intermediate layer impregnated with a fire retardant composition.

SUMMARY OF THE INVENTION

The instant invention constitutes a glove for protecting the hand of a welder from heat and burning during welding operations. Said glove includes a leather outer shell having a thickness in the range of about 0.8 to about 1.9 millimeters. The glove further includes, within said outer shell, an open-celled compressible flame-retardant intermediate layer having a thickness in the range of about 2.3 to about 4.5 millimeters, a density in the range of about 15 to about 25 kilograms per cubic meter, a porosity of 25 to 75 percent, and a compressibility of 25 to 75 percent. The inventive glove further includes a felt-like cotton innermost layer having a multiplicity of convection passages therein, said cotton layer having a thread strand density characteristic in the range of 5 to 30 strands per lineal inch, a thickness in the range of about 1 to about 3 millimeters, and a density in the range of about 100 to about 200 kilograms per cubic meter.

It is therefore an object of the present invention to provide a glove having enhanced thermal insulative and flame-retardant capacity.

It is another object of the present invention to provide a glove of the above type which affords enhanced comfort in the form of improved breathability to the hand of the user and cushioning thereto.

It is a further object of the present invention in which the individually useful characteristics of the inner cotton layer and intermediate foam layer are integrated in a synergetic fashion to provide improved gripping by the user.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
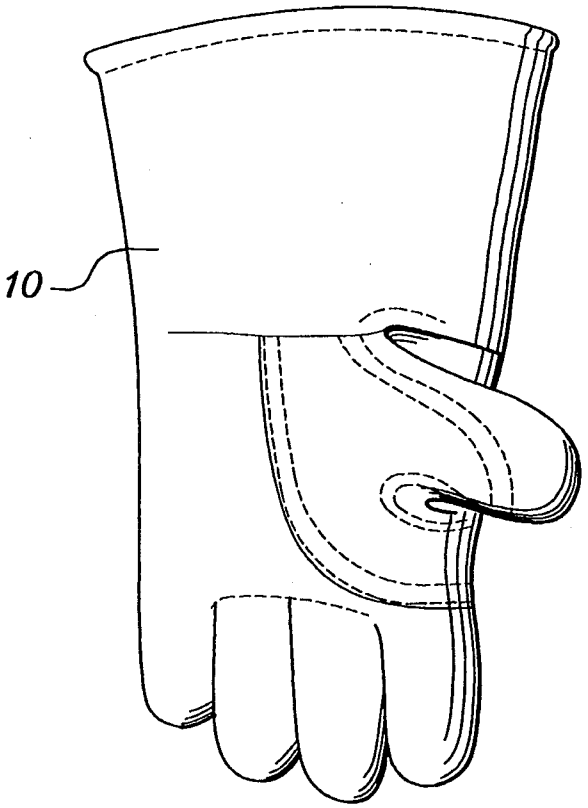
FIG. 1 is an external perspective view of the inventive glove.

With reference to the perspective view of FIG. 1 there is shown the generalized external configuration of the inventive welder's glove 10.

Figure 2:
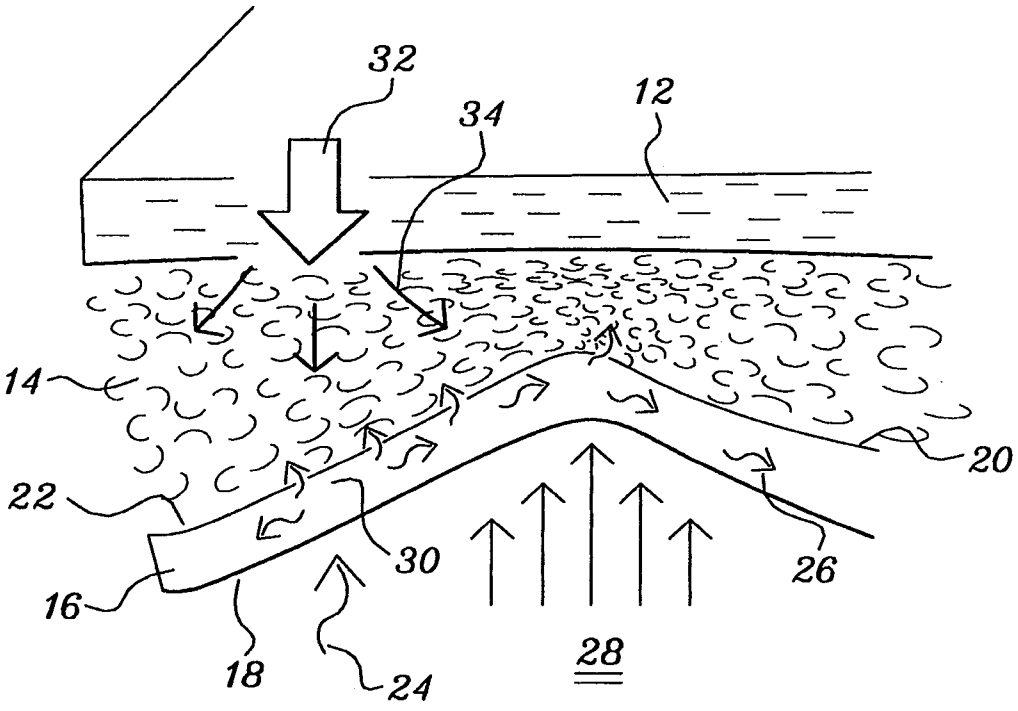
FIG. 2 is a fragmentary schematic sectional view showing the relative arrangement of the layers of the glove and the capability thereof relative to factors of force, heat, air and moisture.

With reference to the view of FIG. 2 there is shown in fragmentary cross-sectional schematic view the basic combination of layers of which the inventive glove system consists. There is, more particularly, shown in the view of FIG. 2 an outer leather shell 12 having a thickness in the range of about 0.8 to about 1.9 millimeters. Such a leather outer shell is selected because of its classical and well-known properties of heat resistance and pleasing natural external texture.

Below said outer leather shell 12 is provided an open-cell compressible flame retardant polymeric layer 14 having a thickness in the range of about 2.3 to about 4.5 millimeters. The use of such a foam-like material creates a flexible air barrier between the external surface of the glove and a felt-like cotton innermost layer 16 (more fully described below) in which such open-cell foam-like layer also provides the cushioning effect associated with the use of foam-like materials. In a preferred embodiment the density of the open-cell layer 14 is in the range of about 15 to about 25 kilograms per cubic meter, while the porosity of said open cell structure is in the range of 25 to 75 percent. Accordingly, because the foam layer is highly compressible, its percent of compressibility will correspond to its porosity.

In addition to the natural air barrier resultant from the use in a confined space of any foam-like structure and its consequential insulative effect relative to heat, the operability of the polymeric layer in terms of retardance of flame to which it may become subject can be substantially increased through the impregnation of the polymeric foam-like layer with fire retardant materials or through provision at the time of original manufacture thereof with a flame retardant compound incorporated into the basic polymer structure, for example, into a polyurethane.

The prior art is replete with formulations for flame retardant polyurethanes which in general, have been developed in response to the needs of manufacturers of household mattresses and pillows where, understandably, the need for a flame retardant polyurethane is most evident. Examples of such flame retardant polyurethane compositions and/or compounds for impregnation thereinto, appear in U.S. Pat. Nos. 4,849,467; 4,880,848; 4,895,878; 4,908,161; and 5,057,545.

The felt-like cotton innermost layer 16 is, as a natural consequence of the weaving thereof, provided with a multiplicity of convection passageways 30. Such a property is obtained through the employment of a thread strand density characteristic in the range of 5 to 30 strands per lineal inch, an overall layer thickness in the range of about 1.0 to about 3.0 millimeters and a density in the range of about 100 to about 200 kilograms per cubic meter.

In the manufacture of the felt-like cotton layer 16 the inner surface 18 of the cotton layer which faces the hand of the welder preferably comprises a thread strand density in the range of 5 to 15 strands per lineal inch while the outer surface 20 of said layer 16, opposing said intermediate polymeric layer 14, preferably constitutes a thread strand density in the range of 15 to 25 strands per lineal inch. It is noted that fewer strands per inch are required on the inner surface 18 since a thicker thread strand is employed. As a result of this particular weaving configuration the inner surface 18, which interfaces with the hand of the user, will be much smoother than will the outer surface 20 which contacts the intermediate layer 14. This arrangement is desirable in that relatively rough texture to inner surface 20 is needed because, adhered upon said surface is a flexible organic glue 22 which, in one embodiment may comprises corn starch, the function of which is to adhere intermediate layer 14 to cotton layer 16 in a manner which will not compromise the flexibility of either the intermediate or inner layer and, further, which will not interfere with the convection capability of the instant system as between the intermediate and inner layers thereof. Accordingly, the selection of an appropriate glue between the intermediate and inner layers is critical in preserving the desired functionality of the system. Absent the use of any glue at all between the intermediate and innermost layers, the respective layers and innermost layers, will lose integrity and stability relative to each other with a resultant early degradation of the structure of both the foam-like intermediate layer 14 and the cotton layer 16. Accordingly, to assure that the intermediate and inner layers will function in an integral and coordinated fashion the use of an adhesive therebetween is essential. However, if care is not taken in the selection of an appropriate adhesive, the flexibility of the interface between the intermediate and inner layers will be compromised and, also, the breathability of the system will be seriously impaired. Accordingly, it has been determined that the use of a flexible organic glue such as corn starch is effective in affording a satisfactory degree of adhesion between the intermediate and inner layers without compromise of flexibility or breathability across the interface therebetween.

A further critical factor in the construction of the instant glove is its thickness, porosity and compressibility. In the instant system it has been discovered that through the use of an open-celled structure, as opposed to the use of a closed cell foam structure as taught in Nelson supra, a greater thickness and therefore wider air barrier can be obtained while still affording sufficient compressibility and convection necessary to absorb and diffuse air 24, moisture 26, and force 28 entering the intermediate layer 14 through the innermost layer 16. The convection passageways 30 also absorb and diffuse heat 32 entering the intermediate layer through leather outer shell 12. It is therefore to be understood that the function of intermediate foam-like layer 16 is manifold. That is, outer shell 12 after absorbing heat 32, diffuses it in the manner shown by arrows 34 while providing an air barrier between the external welding environment and the hand of the operator, while also providing as above noted, properties of fire and flame retardance. Concurrently, from the inner direction, that is, from the hand of the operator, it absorbs pressure/force 28, air 24, and moisture 26, to provide comfort and gripping to the hand of the user. Accordingly, the selection of an open-cell foam-like material of appropriate thickness, density and compressibility is critical to the success of the instant system. As above noted, it has been found that a polyurethane having a density in the range of 17 to 25 kilograms per cubic meter and a compressibility of 15 to 75 percent is suitable to the present application. Also, a thickness in the range of 2.3 to 4.5 millimeters will afford a sufficient air barrier and cushioning effect to the human hand to be effective for the above set forth purposes. Accordingly, the thickness of the foam-like layer 14 is approximately double the thickness of the cotton innermost layer 16.

The use of classical soft-brushed felt-like cotton as the innermost layer of a work glove has become time honored in the art because such compressed cotton, when woven with sufficient thread density, affords comfort to the user and a certain measure of thermal insulation; that is, because of its internal knitted structure it provides natural insulative properties as well as the above noted convection passageways 30 through which moisture and air may pass. Further, as may be noted in the view of FIG. 2, a property of a felt-like cotton is that moisture 26 may also move laterally within the cotton, this corresponding to the well-known moisture absorptive properties of cotton which make it desirable as a material in many types of apparel.

It is therefore to be appreciated that through the discovery of the value of an open-cell compressible foam-like material as the intermediate layer, and of a means for assuring structural and functional integration between such intermediate layer and the above noted felt-like cotton innermost layer, a system having novel properties of comfort, safety and functionality has been accomplished.

Accordingly, while there has been shown and described the preferred embodiment of the present invention, it is to be appreciated that the invention may be embodied otherwise than is herein specifically shown and described and, that within such embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. A glove for the protection of the hand of a welder from heat and burning during welding operations, the glove comprising:

(a) a leather outer shell having a thickness in the range of about 0.8 to about 1.9 millimeters;

(b) within said outer shell, an open-cell compressible flame-retardant intermediate foam-like layer having thickness in the range of about 2.3 to about 4.5 millimeters, a density in the range of about 15 to about 25 kilograms per cubic meter, and a porosity and compressibility in the range of about 25 to about 75 percent; and (c) a felt-like cotton innermost layer having a multiplicity of convection passages therein, said innermost layer having a thread strand density characteristic in the range of about 5 to about 30 threads per lineal inch, a thickness in the range of about 1 to about 3 millimeters, and a density in the range of about 100 to about 200 kilograms per cubic meter, in which the density of said innermost layer is in the range of about five to ten times the density of said intermediate layer, whereby a glove of enhanced comfort and insulative capacity is thereby obtained.

2. The glove in claim 1 in which said intermediate layer comprises a polyurethane.

3. The glove as recited in claim 1 in which said outer surface of said outer surface of said cotton layer is bonded to an opposing surface of said intermediate foam-like layer by a substantially uniform layer of a flexible breathable glue.

4. The glove as recited in claim 3 in which said flexible glue comprises an organic glue.

5. The glove as recited in claim 4 in which said organic glue comprises corn starch.

6. The glove as recited in claim 3 in which the thickness of said intermediate layer is about double the thickness of said innermost layer.

7. The glove as recited in claim 6 in which said intermediate layer comprises a polyurethane.

8. A glove for the protection of the hand of a welder from heat and burning during welding operations, the glove comprising:

(a) a leather outer shell having a thickness in the range of about 0.8 to about 1.9 millimeters;

(b) within said outer shell, an open-cell compressible flame-retardant polymeric intermediate foam-like layer having a thickness in the range of about 2.3 to about 4.3 millimeters, a density in the range of about 17 to about 25 kilograms per cubic meter, and a porosity and compressibility in the range of about 25 to about 75 percent; and (c) a soft-brushed felt-like cotton innermost layer having a multiplicity of convection passages therein, said innermost layer having a thread strand density characteristic in the range of about 8 to about 24 strands per lineal inch, a thickness in the range of about 1 to about 3 millimeters, and a density in the range of about 100 to about 200 kilograms per cubic meter in which the density of said innermost layer is in the range of about five to ten times the density of said intermediate layer, whereby a glove of enhanced comfort and insulative and gripping capacity is thereby obtained.

9. The glove recited in claim 8 in which said intermediate layer comprises a polyurethane.

10. The glove as recited in claim 9 in which said outer surface of said outer surface of said cotton layer is bonded to an opposing surface of said intermediate foam-like layer by a substantially uniform layer of a flexible breathable glue.

11. The glove as recited in claim 10 in which said flexible glue comprises an organic glue.

12. The glove as recited in claim 11 in which said organic glue comprises corn starch.

* * * * *